US006851460B2

(12) United States Patent
Tamai

(10) Patent No.: US 6,851,460 B2
(45) Date of Patent: Feb. 8, 2005

(54) LIQUID CRYSTAL DROPPING APPARATUS AND METHOD, AND LIQUID CRYSTAL DISPLAY PANEL PRODUCING APPARATUS

(75) Inventor: Shingo Tamai, Kanagawa (JP)

(73) Assignee: Shibaura Mechatronics Corporation, Yokohama (JP)

( * ) Notice: Subject to any disclaimer, the term of this patent is extended or adjusted under 35 U.S.C. 154(b) by 0 days.

(21) Appl. No.: 10/367,426

(22) Filed: Feb. 14, 2003

(65) Prior Publication Data

US 2003/0155033 A1 Aug. 21, 2003

(30) Foreign Application Priority Data

Feb. 19, 2002 (JP) ..... 2002-042379

(51) Int. Cl.[7] ..... B65B 1/04

(52) U.S. Cl. ..... 141/102; 141/392; 141/285; 141/236

(58) Field of Search ..... 141/102–130, 141/237, 181, 392, 285, 236; 222/1, 137, 402.24; 422/100, 101, 102; 445/24, 51; 349/187; 438/30, 28

(56) References Cited

U.S. PATENT DOCUMENTS 6,039,211 A * 3/2000 Slater et al. ..... 222/1
6,210,245 B1 * 4/2001 Sando et al. ..... 445/6
6,220,912 B1 * 4/2001 Shigeoka et al. ..... 445/24
6,506,611 B2 * 1/2003 Bienert et al. ..... 436/180
6,637,476 B2 * 10/2003 Massaro ..... 141/237
2002/0060713 A1 * 5/2002 Katakura et al.
2003/0184613 A1 * 10/2003 Nakamura et al.
2003/0215957 A1 * 11/2003 Lemmo et al.

FOREIGN PATENT DOCUMENTS

JP 10-221666 8/1998
JP 2001-133799 * 5/2001
JP 2001-330840 A 11/2001
JP 2002-014360 * 1/2002

OTHER PUBLICATIONS

Copy of related U.S. Appl. No. 10/372,453 filed Feb. 24, 2003; Inventors: Shinichi Ogimoto et al; Title: Substrate Lamimating Apparatus and Method thereof and Substrate Detecting Apparatus.

* cited by examiner

*Primary Examiner*—Gregory L. Huson
*Assistant Examiner*—Khoa Huynh
(74) *Attorney, Agent, or Firm*—Frishauf, Holtz, Goodman & Chick, P.C.

(57) ABSTRACT

Liquid crystal dropping apparatus and method for dropping liquid crystal discharged from discharging ports of a liquid crystal dropping head on a planned drop region, wherein the liquid crystal is discharged only from one or some of discharging ports located in correspondence with the planned drop region among a plurality of discharging ports of the liquid crystal dropping head.

14 Claims, 6 Drawing Sheets

LIQUID CRYSTAL DROPPING APPARATUS AND METHOD, AND LIQUID CRYSTAL DISPLAY PANEL PRODUCING APPARATUS

BACKGROUND OF THE INVENTION

1. Field of the Invention

The present invention relates to liquid crystal dropping apparatus and method, and a liquid crystal display panel producing apparatus.

2. Description of the Related Art

Generally, a liquid crystal display panel producing apparatus inserts liquid crystal between a lower substrate and an upper substrate and bonds the lower substrate and the upper substrate. The liquid crystal display panel producing apparatus comprises a sealing agent drawing apparatus for drawing a sealing agent with a closed pattern along an outer edge of the lower substrate, a liquid crystal dropping apparatus for dropping the liquid crystal on a planned drop region surrounded by the sealing agent of the lower substrate, a substrate bonding apparatus for bonding the lower substrate to the upper substrate under a reduced pressure so that air bubbles do not remain in the liquid crystal, and a sealing agent hardening apparatus to harden the sealing agent interposed between the upper substrate and the lower substrate.

As a conventional liquid crystal dropping apparatus, as described in Japanese Patent Applications Laid-open No. H10-221666 and No. 2001-330840, there is proposed an apparatus in which liquid crystal discharged from a plurality of discharging ports of ink-jet type liquid crystal dropping head is allowed to drop on the planned drop region on the lower substrate.

In the conventional liquid crystal dropping apparatus, the liquid crystal is discharged from all of the discharging ports of the liquid crystal dropping head, and there are problems as follows:

1) When an entire dropping subject width W of the planned drop region based on a substrate size has a relation of ($W=n\times L+\alpha$ (n is an integer, $\alpha<L$)) with respect to an entire discharging width L of the liquid crystal from all the discharging ports of the liquid crystal dropping head, a liquid crystal band-like body of at least a width L which is dropped at the time of the last scanning of the liquid crystal dropping head which is scanned on the planned drop region in a form of a U-turn shape is superposed on a portion of the width of the liquid crystal band-like body of a width L on which the liquid crystal is dropped at the time of the last scanning but one. Therefore, the liquid crystal can not be dispersed uniformly over the entire region of the planned drop region on the substrate, which deteriorates the display precision of the liquid crystal.

2) Since a constant amount of liquid crystal is discharged from all of the discharging ports of the liquid crystal dropping head, it is not possible to control the dropping amount of the liquid crystal with respect to the planned drop region. Therefore, when the lower substrate and the upper substrate are bonded to each other, it is difficult to prevent the liquid crystal from overflowing from the sealing agent and to prevent a sealing failure from being generated, because it is difficult that the dropping amount of the liquid crystal in a region along the sealing agent is reduced with respect to the dropping amount of the liquid crystal in a central region on the lower substrate.

SUMMARY OF THE INVENTION

It is an object of the present invention to provide a liquid crystal dropping apparatus and method, and a liquid crystal display panel producing apparatus capable of precisely dropping liquid crystal.

According to the present invention, a liquid crystal dropping apparatus is provided for dropping liquid crystal discharged from discharging ports of a liquid crystal dropping head on a planned drop region. The apparatus has a discharging driving section for discharging the liquid crystal from each of the discharging ports of the liquid crystal dropping head. The apparatus also has a control apparatus for controlling the discharging driving section to control a discharging state of the liquid crystal for each of the discharging ports. The control apparatus may control the discharging driving section to control a discharging state of the liquid crystal for each of groups of the discharging ports.

A liquid crystal dropping method for dropping liquid crystal discharged from discharging ports of a liquid crystal dropping head on a planned drop region comprises discharging the liquid crystal only from one or some of discharging ports located in correspondence with the planned drop region among the plurality of discharging ports of the liquid crystal dropping head. The liquid crystal may be discharged only from one or some of discharging ports among a plurality of discharging ports located in correspondence with the planned drop region of the liquid crystal dropping head.

BRIEF DESCRIPTION OF THE DRAWINGS

The present invention will be more fully understood from the detailed description given below and from the accompanying drawings which should not be taken to be a limitation on the invention, but are for explanation and understanding only.

DETAILED DESCRIPTION

Figure 1:
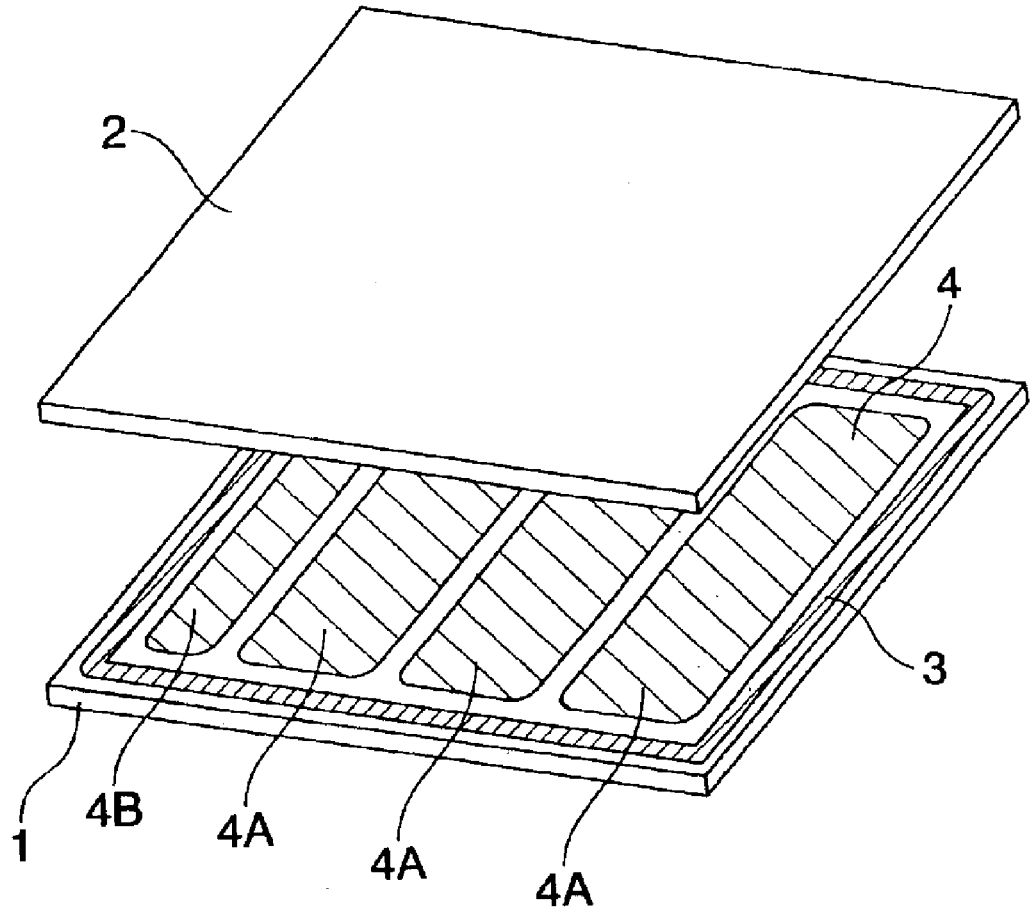
FIG. 1 is a schematic view showing a producing process by a liquid crystal display panel producing apparatus.

FIG. 1 shows a producing process by a liquid crystal display panel producing apparatus. The liquid crystal display panel producing apparatus charges a liquid crystal 4 into a region surrounded by a sealing agent 3 comprising adhesive between a lower glass substrate 1 and an upper glass substrate 2, and bonds the lower glass substrate 1 and the upper glass substrate 2 to each other to produce a liquid crystal display panel.

Figure 6:
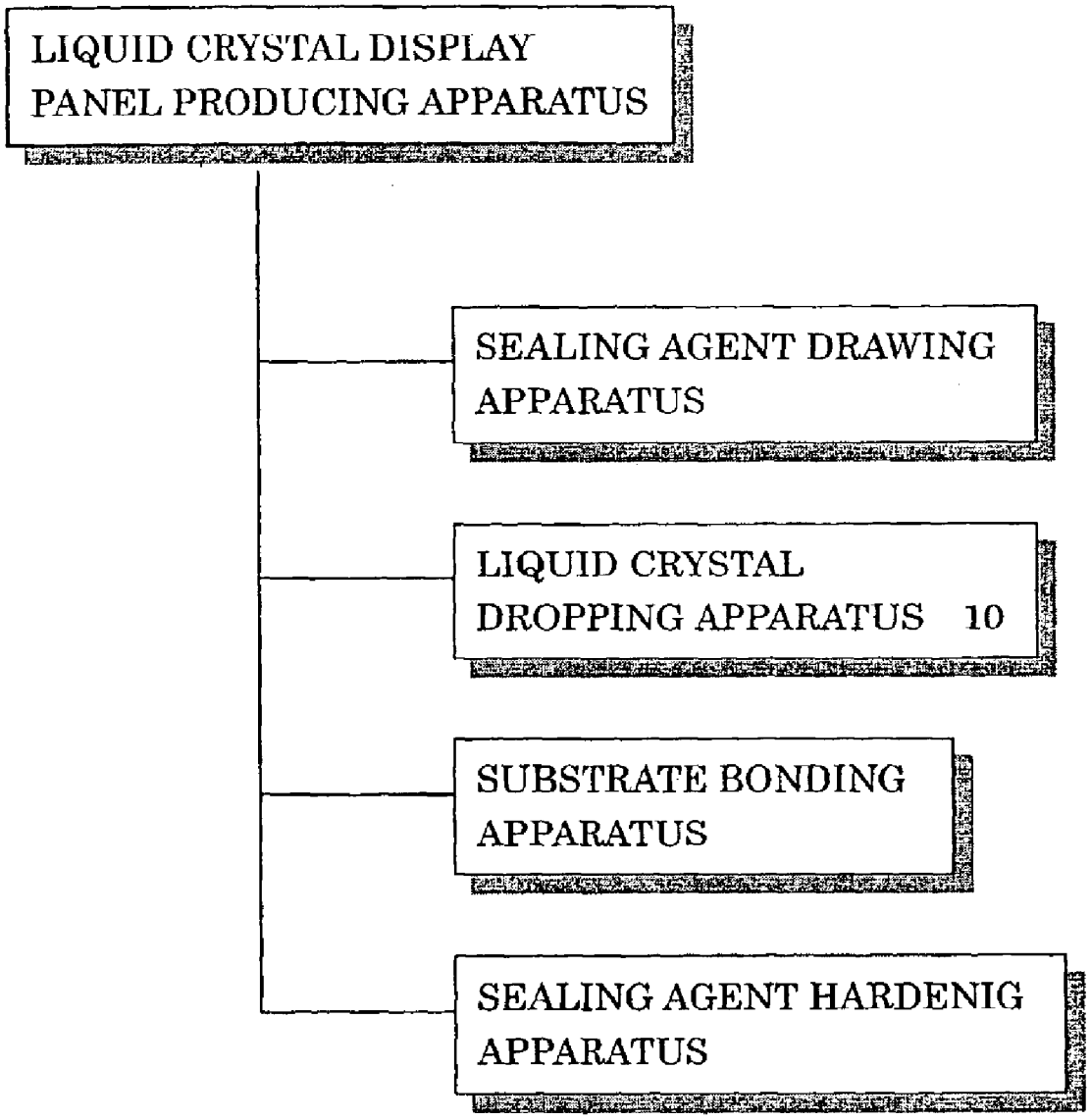
FIG. 6 is a block diagram showing a liquid crystal display panel producing apparatus.

The liquid crystal display panel producing apparatus comprises, as shown in FIG. 6, a sealing agent drawing apparatus for applying the sealing agent 3 with a closed pattern along an outer edge of the lower glass substrate 1, a liquid crystal dropping apparatus 10 (FIGS. 2A and 2B) for dropping the liquid crystal 4 to a planned drop region of the lower glass substrate 1 surrounded by the sealing agent 3, a substrate bonding apparatus for bonding the upper glass substrate 2 to the lower glass substrate 1 under a reduced pressure so that air bubbles do not remain in the liquid crystal 4, and a sealing agent hardening apparatus to harden the sealing agent 3 interposed between the lower glass substrate 1 and the upper glass substrate 2.

Figure 2A:
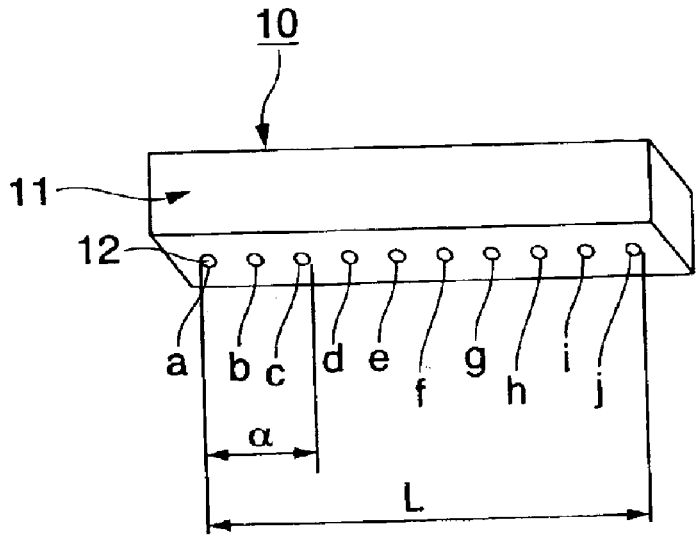
FIGS. 2A and 2B are schematic views showing a liquid crystal dropping apparatus.
Figure 2B:
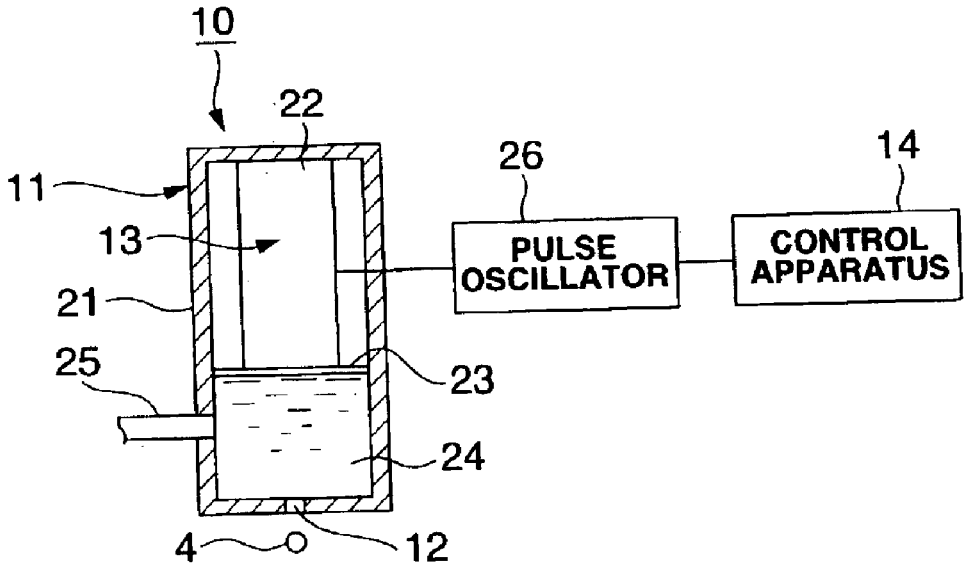

In the liquid crystal dropping apparatus 10, as shown in FIGS. 2A and 2B, an ink-jet type liquid crystal dropping head 11 scans the entire planned drop region of the lower glass substrate 1 in X direction and Y direction and in this scanning process, liquid crystal 4 discharged from the plurality of discharging ports 12 (a . . . j) forming one line of the liquid crystal dropping head 11 is dropped on the planned drop region on the lower glass substrate 1. As scanning patterns of the liquid crystal dropping head 11 in the liquid crystal dropping apparatus 10 with respect to the substrate, three patterns can be considered, i.e., 1) the liquid crystal dropping head is fixed in the XY direction and the substrate moves in the XY direction, 2) the substrate is fixed in the XY direction and the liquid crystal dropping head moves in the XY direction, and 3) the liquid crystal dropping head moves in one of the X and Y directions and the substrate moves in the other of the X and Y directions.

The liquid crystal dropping apparatus 10 includes a discharging driving section 13 for discharging the liquid crystal 4 from the discharging ports 12 of the liquid crystal dropping head 11, and a control apparatus 14 for controlling the discharging driving section 13.

The discharging driving section 13 is provided with piezoelectric elements 22 respectively corresponding to the discharging ports 12 in the housing 21 of the liquid crystal dropping head 11. Independent liquid crystal pressurizing chambers 24 corresponding to the discharging ports 12 are provided by partition plates 23 provided on lower ends of the piezoelectric elements 22. A liquid crystal supply pipe 25 is connected to a side portion of the liquid crystal pressurizing chamber 24. The discharging ports 12 are formed in bottoms of the liquid crystal pressurizing chamber 24.

The control apparatus 14 controls the discharging driving section 13 of the liquid crystal dropping head 11, and controls a discharge amount of liquid crystal for each of the plurality of discharging ports 12. More specifically, the control apparatus 14 applies a voltage to the piezoelectric elements 22 corresponding to the discharging ports 12 by a pulse oscillator 26, and liquid crystal in the liquid crystal pressurizing chamber 24 is pressurized and pushed out by the partition plate 23 provided on the piezoelectric elements 22, thereby discharging the liquid crystal from the discharging ports 12. The discharging operation is repeated by the number of pulses applied from the pulse oscillator 26.

The control apparatus 14 can also control the discharging driving section 13 of the liquid crystal dropping head 11, and control a discharging amount of liquid crystal for groups of the plurality of discharging ports 12. More specifically, the control apparatus 14 applies voltage to the piezoelectric elements 22 corresponding to groups of discharging ports 12 comprising a predetermined number of discharging ports 12 among the discharging ports 12 by the pulse oscillator 26, and liquid crystal in the corresponding liquid crystal pressurizing chambers 24 is pushed out by the partition plate 23 provided on the piezoelectric elements 22, thereby discharging the liquid crystal from the groups of discharging ports 12. In this case, the discharging driving section 13 may be provided with piezoelectric elements 22 which are independent corresponding to each of the groups of the discharging ports 12 in the housing 21 of the liquid crystal dropping head 11, and the liquid crystal pressurizing chambers 24 may be provided independently corresponding to each of the groups of the discharging ports 12 by the partition plate 23 provided on the lower ends of the piezoelectric elements 22. For example, three discharging ports a to c are set to one set, and this one set of the discharging ports a to c is applied to a single liquid crystal pressurizing chamber 24, and then, the single liquid crystal pressuring chamber 24 is provided with a single piezoelectric element 22.

Figure 3A:
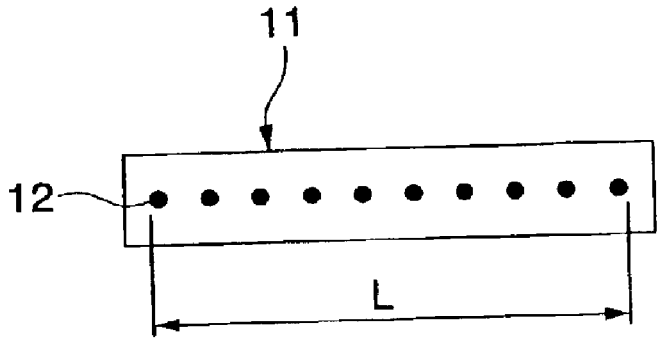
FIGS. 3A to 3C are schematic views showing a control mode of a liquid crystal dropping head.
Figure 3B:
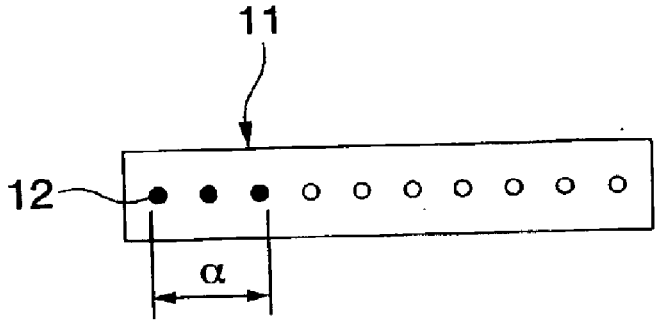
Figure 3C:
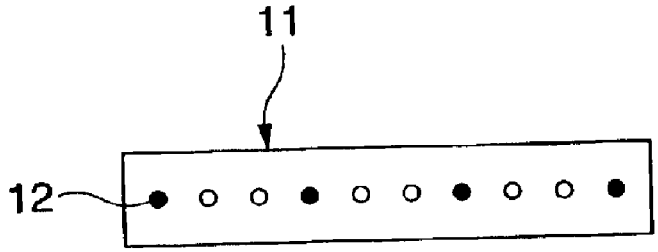

The liquid crystal dropping mode of the liquid crystal dropping apparatus 10 can variously be modified by control apparatus 14. Examples are shown in FIGS. 3A to 3C. FIG. 3A shows a mode in which liquid crystal is discharged over the entire discharging width L from all the discharging ports 12 of the liquid crystal dropping head 11. FIG. 3B shows a mode in which liquid crystal is discharged to a partial discharging width $\alpha$ only from one or some of adjacent discharging ports 12 (the number of discharging ports 12 corresponds to the partial discharging width $\alpha$) among all the discharging ports 12 of the liquid crystal dropping head 11. FIG. 3C shows a mode in which liquid crystal is discharged in a dispersion manner only from one or some of discharging ports 12 located at intervals among all the discharging ports 12 of the liquid crystal dropping head 11. In FIGS. 3A to 3C, liquid crystal 4 is discharged from blackened discharging ports 12.

In the liquid crystal dropping apparatus 10, when the entire dropping subject width W of the planned drop region of the lower glass substrate 1 is wider than the entire discharging width L of the liquid crystal 4 from all the discharging ports 12 of the liquid crystal dropping head 11, the liquid crystal dropping head 11 scans the planned drop region in the form of U-turn, and the liquid crystal band-like body having a width L dropped on each the scanning line by the liquid crystal dropping head 11 is arranged on the planned drop region.

In this case, the liquid crystal dropping mode by the liquid crystal dropping apparatus 10 can be controlled in the following manners (A) and (B) for example.

(A) Control of dropping width

Figure 4A:
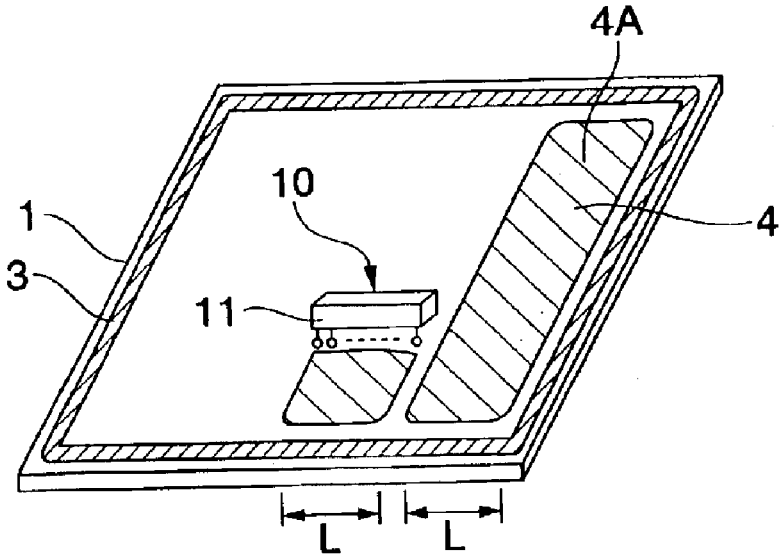
FIGS. 4A and 4B are schematic views showing a liquid crystal dropping mode.
Figure 4B:
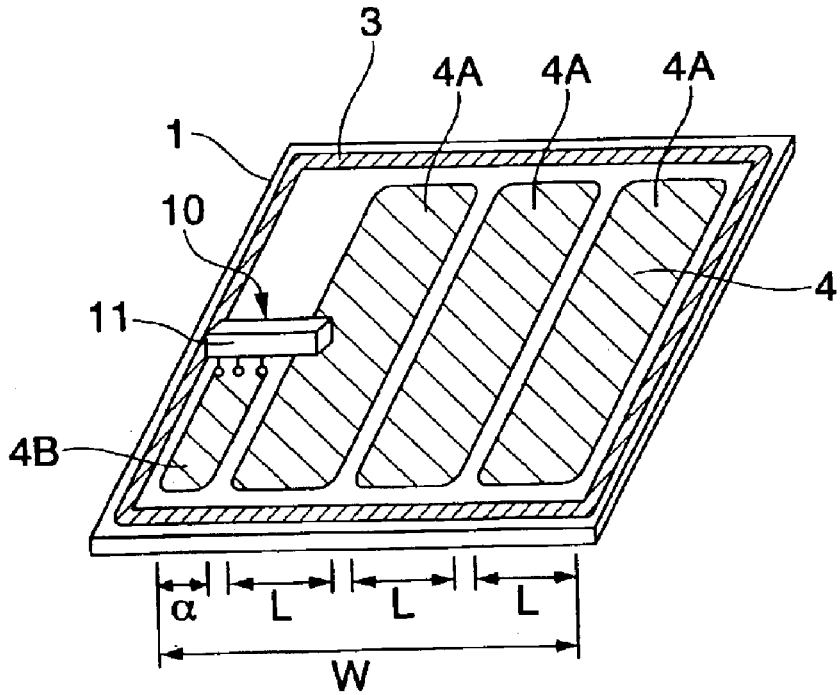

When the entire dropping subject width W of the planned drop region of the lower glass substrate 1 has a relation ($W=n\times L+\alpha$ (n is an integer, $\alpha<L$)) with respect to the entire discharging width L of the liquid crystal dropping head 11, the liquid crystal dropping mode of the liquid crystal dropping head 11 is controlled as shown in FIG. 3A at the time of the last scanning but one among all scanning carried out by the liquid crystal dropping head 11 for the entire planned drop region of the lower glass substrate 1, n-number of liquid crystal band-like bodies 4A having discharging width L are arranged on the planned drop region of the lower glass substrate 1 (FIG. 4A), and at the time of the last scanning, the liquid crystal dropping mode of the liquid crystal dropping head 11 is controlled as shown in FIG. 3B, a liquid crystal band-like body 4B corresponds to the partial discharging width $\alpha$ is dropped on a remaining planned drop region which is a planned drop region of this time of the lower glass substrate 1 (FIG. 4B).

(B) Control of dropping amount (discharging intervals)

In a planned drop region corresponding to a central portion of the planned drop region of the lower glass substrate 1 separated away, by a constant length, from a sealing agent 3 formed along an outer edge of the lower glass substrate 1, a liquid crystal dropping mode of the liquid crystal dropping head 11 is controlled as shown in FIG. 3A, and the liquid crystal 4 is dropped on the lower glass substrate 1 with a standard charging amount. In a planned drop region corresponding to an outer peripheral portion along the sealing agent 3 of the planned drop region of the lower glass substrate 1, the liquid crystal dropping mode of the liquid crystal dropping head 11 is controlled as shown in FIG. 3C, and the liquid crystal discharging amount is reduced. That is, a planned entire drop region on the lower glass substrate 1 is formed in parallel by a planned drop region of each scanning of the liquid crystal dropping head 11. Among these planned drop regions, in a planned drop region adjacent to the sealing agent 3 formed along the scanning direction of the liquid crystal dropping head 11, the liquid crystal discharging amount is reduced over the entire planned drop region. In a planned drop region crossing the central portion of the lower glass substrate 1, liquid crystal 4 is discharged with the standard discharging amount in a region corresponding to the central portion of that planned drop region, and in another region, i.e., a region corresponding to the outer periphery along the sealing agent 3, the liquid crystal discharging amount is reduced. With this method, the dropping amount on the outer periphery along the sealing agent 3 of the lower glass substrate 1 can be reduced as compared with the central portion. Therefore, dispersion of the liquid crystal 4 when the upper glass substrate 2 is bonded to the lower glass substrate 1 can be restrained around the outer peripheral portion. As a result, it is possible to prevent the liquid crystal 4 from overflowing from the sealing agent 3.

According to the above-described embodiment, the following effects can be obtained.

(1) The discharging amount of the liquid crystal 4 can be controlled for each of the plurality of discharging ports 12 of the liquid crystal dropping head 11. Therefore, it is possible to control the discharging width and discharging intervals of the liquid crystal 4 by the liquid crystal dropping apparatus 10, and it is possible to precisely drop the liquid crystal 4 on the planned drop region of the lower glass substrate 1.

(2) The discharging amount of the liquid crystal 4 can be controlled for each group of the plurality of discharging ports 12 of the liquid crystal dropping head 11. Therefore, it is possible to control the discharging width and discharging intervals of the liquid crystal 4 by the liquid crystal dropping apparatus 10, and it is possible to precisely drop the liquid crystal 4 on the planned drop region of the lower glass substrate 1.

(3) The liquid crystal can be discharged only from one or some of discharging ports 12 located in correspondence with the current planned drop region among the plurality of discharging ports 12 of the liquid crystal dropping head 11. Therefore, when the entire dropping subject width W in the planned drop region has $\alpha$ fraction a with respect to a value which is an integer times of the entire discharging width L of the liquid crystal dropping head 11, it is possible to drop the liquid crystal 4 by the fraction $\alpha$. Therefore, it is possible to disperse the liquid crystal 4 uniformly on the entire planned drop region on the lower glass substrate 1, and it is possible to enhance the liquid crystal display precision.

(4) The liquid crystal 4 can be discharged only from one or some of discharging ports 12 among the plurality of discharging ports 12 located in correspondence with the current planned drop region of the liquid crystal dropping head 11. Therefore, it is possible to change the dropping amount of the liquid crystal 4 in the planned drop region on the lower glass substrate 1. Thus, it is possible to reduce the dropping amount of the liquid crystal 4 with respect to a region along the sealing agent 3 on the lower glass substrate 1, and it is possible to prevent the liquid crystal 4 from overflowing from the sealing agent 3 and to prevent a sealing failure from being generated.

(5) In the liquid crystal display panel producing apparatus, it is possible to realize the above effects (1) to (4), and to produce a high quality liquid crystal display panel.

In FIGS. 4A and 4B, the liquid crystal dropping mode in which the liquid crystal dropping head 11 drops the liquid crystal on the lower glass substrate 1 is a thin film band-like pattern. This liquid crystal dropping mode may be a dot-like pattern, such as shown in FIGS. 5A to 5C.

Figure 5A:
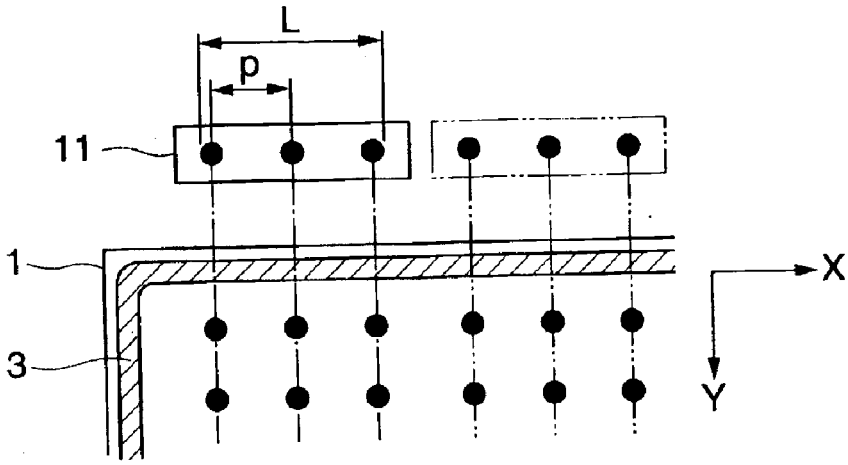
FIGS. 5A to 5C are schematic views showing another example of the liquid crystal dropping mode.
Figure 5B:
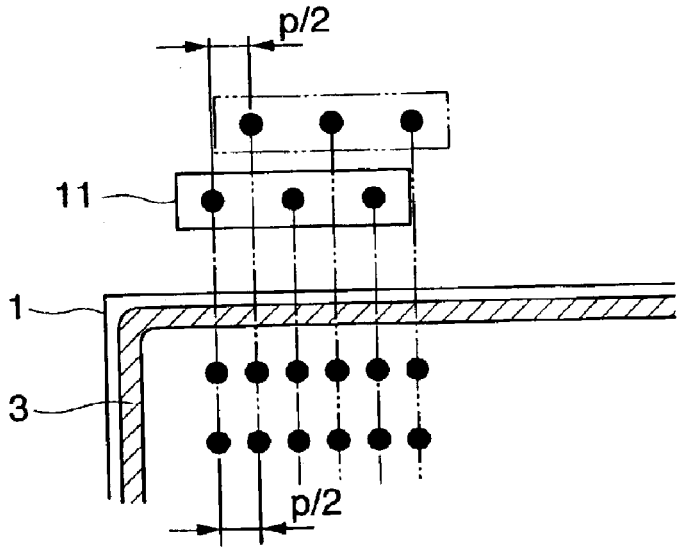
Figure 5C:
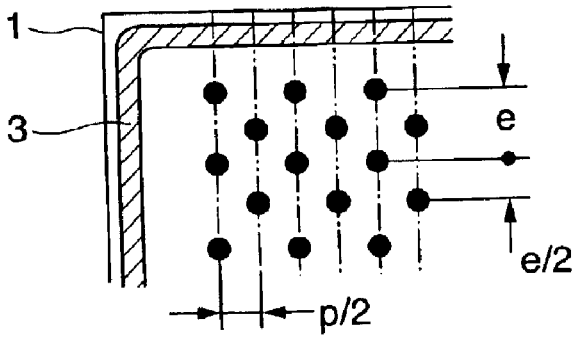

FIGS. 5A to 5C show the number of the discharging ports as three, to make the explanation simple.

FIG. 5A shows a liquid crystal dropping mode in which among all scanning carried out by the liquid crystal dropping head 11 for the entire planned drop region of the lower glass substrate 1, in this time and the next time scanning, the liquid crystal dropping head 11 is laterally moved in the X direction by the entire discharging width L with respect to the scanning direction, e.g., the Y direction. The liquid crystal is dropped on the lower glass substrate 1 with the same pitch as a distance p of each the discharging ports 12 in the liquid crystal dropping head 11.

FIG. 5B shows a liquid crystal dropping mode in which among all scanning carried out by the liquid crystal dropping head 11 for the entire planned drop region of the lower glass substrate 1, in this time and the next time scanning, the liquid crystal dropping head 11 is laterally moved in the X direction (see FIG. 5A) with respect to the scanning direction, e.g., the Y direction, by a plurality of dividing widths (e.g., p/2, p/3 or the like) of each discharging port 12 in the liquid crystal dropping head 11. In the liquid crystal dropping mode in FIG. 5B, the dropping interval in a direction (X) perpendicular to the scanning direction (Y) of the liquid crystal dropping head 11 is shortened as compared with the mode shown in FIG. 5A.

FIG. 5C shows a liquid crystal dropping mode in which among all scanning carried out by the liquid crystal dropping head 11 for the entire planned drop region of the lower glass substrate 1, in this time and the next time scanning, (a) the liquid crystal dropping head 11 is laterally moved in the X direction with respect to the scanning direction, e.g., in the Y direction, by a plurality of dividing widths (e.g., p/2, p/3 or the like) of the interval p of each discharging port 12 in the liquid crystal dropping head 11, and (b) the dropping position from each discharging port 12 of the liquid crystal dropping head 11 is deviated in the scanning direction of the liquid crystal dropping head 11, e.g., in the Y direction, by a plurality of dividing lengths (e.g., e/2, e/3 or the like) of the dropping interval e in the scanning direction at the time of the current scanning of the liquid crystal dropping head. 11. In the liquid crystal dropping mode in FIG. 5C, the dropping interval in a scanning direction of the liquid crystal dropping head 11 and a direction perpendicular to the scanning direction is shortened as compared with the mode shown in FIG. 5A.

According to the liquid crystal dropping modes in FIGS. 5B and 5C, a liquid crystal dropping amount per dropping point is reduced as compared to that shown in FIG. 5A, the liquid crystal can be dropped on the lower glass substrate 1 with a smaller pitch than the interval of the discharging ports 12 of the liquid crystal dropping head 11, and it is possible to drop the liquid crystal more uniformly over the entire planned drop region. With this technique, when the substrates are bonded to each other, the liquid crystal spreads between the substrates excellently, and it is possible to produce a high quality liquid crystal display panel.

The adjusting technique of the dropping mode which controls, as shown in FIGS. 5B and 5C, the lateral movement of the liquid crystal dropping head 11 in a direction perpendicular to the scanning direction between the scanning operations in the liquid crystal dropping head 11, and the dropping position of each discharging ports 12 in the scanning direction of the liquid crystal dropping head 11, as well as merits based on the adjusting technique, can also be similarly employed in the dropping mode of the thin band-like pattern shown in FIGS. 4A and 4B.

As heretofore explained, embodiments of the present invention have been described in detail with reference to the drawings. However, the specific configurations of the present invention are not limited to the illustrated embodiments but those having a modification of the design within the scope of the present invention are also included in the present invention. For example, in an embodiment of the present invention, among the plurality of discharging ports of the liquid crystal dropping head, specific some or only one of discharging ports may be removed from the discharging control subject and may be brought into a state in which the discharging ports can always discharge liquid crystal, and discharging states of only the other discharging ports may be controlled. The discharging state of liquid crystal discharged from the discharging ports controlled by the control apparatus may include not only the discharging amount of liquid crystal, but also a discharging speed and the number of discharging operations per unit time. Further, plurality of discharging ports of the liquid crystal dropping head can be provided in two or more lines, not in one line.

The liquid crystal may be dropped on the upper glass substrate from the liquid crystal dropping apparatus. A material of the substrate on which the liquid crystal is dropped is not limited to glass.

As described above, according to the present invention as explained above, liquid crystal can be dropped on a substrate precisely.

Although the invention has been illustrated and described with respect to exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiments set out above, but should be understood to include all possible embodiments which can be embodied within a scope encompassed and equivalents thereof with respect to the features set out in the appended claims.

What is claimed is:

1. A liquid crystal dropping apparatus for dropping liquid crystal discharged from discharging ports of a liquid crystal dropping head on a planned drop region, comprising:

a discharging driving section for discharging the liquid crystal from each of the discharging ports of the liquid crystal dropping head; and a control apparatus for controlling the discharging driving section to control a discharging state of the liquid crystal for each of the discharging ports, wherein when an entire dropping subject width W of the planned drop region has a relation ($W=n\times L+\alpha$ (n is an integer, $\alpha<L$)) with respect to an entire discharging width L of the liquid crystal dropping head, at the time of a last scanning but one among all scanning carried out by the liquid crystal dropping head for the entire planned drop region, n number of liquid crystal band-like bodies having discharging width L are arranged on the planned drop region, and at the time of the last scanning, a liquid crystal band-like body corresponds to the partial discharging width $\alpha$ is dropped on a remaining planned drop region which is the planned drop region of this time.

2. The liquid crystal dropping apparatus according to claim 1, wherein the control apparatus controls the discharging driving section such that the liquid crystal is discharged only from some of discharging ports located in correspondance with the planned drop region among the plurality of discharging ports of the liquid crystal dropping head.

3. The liquid crystal display panel producing apparatus having a liquid crystal dropping apparatus as described in claim 2.

4. The liquid crystal dropping apparatus according to claim 1, wherein the control apparatus controls the discharging driving section such that the liquid crystal is discharged only from some of discharging ports among the plurality of discharging ports located in correspondence with the planned drop region of the liquid crystal dropping head.

5. The liquid crystal display panel producing apparatus having a liquid crystal dropping apparatus as described in claim 4.

6. The liquid crystal display panel producing apparatus having a liquid crystal dropping apparatus as described in claim 1.

7. A liquid crystal dropping apparatus for dropping liquid crystal discharged from discharging ports of a liquid crystal dropping head on a planned drop region, comprising:

a discharging driving section for discharging the liquid crystal from each of the discharging ports of the liquid crystal dropping head; and a control apparatus for controlling the discharging driving section to control a discharging state of the liquid crystal for each group of discharging ports, wherein when an entire dropping subject width W of the planned drop region has a relation ($W=n\times L+\alpha$ (n is an integer, $\alpha<L$)) with respect to an entire discharging width L of the liquid crystal dropping head, at the time of a last scanning but one among all scanning carried out by the liquid crystal dropping head for the entire planned drop region, n number of liquid crystal band-like bodies having discharging with L are arranged on the planned drop region, and at the time of the last scanning, a liquid crystal band-like body corresponds to the partial discharging width $\alpha$ is dropped on a remaining planned drop region which is the planned drop region of this time.

8. The liquid crystal dropping apparatus according to claim 7, wherein the control apparatus controls the discharging driving section such that the liquid crystal is discharged only from some of discharging ports located in correspondance with the planned drop region among the plurality of discharging ports of the liquid crystal dropping head.

9. The liquid crystal display panel producing apparatus having a liquid crystal dropping apparatus as described in claim 8.

10. The liquid crystal dropping apparatus according to claim 7, wherein the control apparatus controls the discharging driving section such that the liquid crystal is discharged only from some of discharging ports among the plurality of discharging ports located in correspondence with the planned drop region of the liquid crystal dropping head.

11. The liquid crystal display panel producing apparatus having a liquid crystal dropping apparatus as described in claim 10.

12. The liquid crystal display panel producing apparatus having a liquid crystal dropping apparatus as described in claim 7.

13. A liquid crystal dropping method for dropping liquid crystal discharged from discharging ports of a liquid crystal dropping head on a planned drop region, comprising:

discharging the liquid crystal from discharging ports located in correspondence with the planned drop region among the plurality of discharging ports of the liquid crystal dropping head, wherein when an entire dropping subject width W of the planned drop region has a relation ($W=n\times L+\alpha$ (n is an integer, $\alpha<L$)) with respect to the entire discharging width L of the liquid crystal dropping head, at the time of a last scanning but one among all scanning carried out by the liquid crystal dropping head for the entire planned drop region, n number of liquid crystal band-like bodies having discharging width L are arranged on the planned drop region, and at the time of the last scanning, a liquid crystal band-like body corresponds to the partial discharging width $\alpha$ is dropped on a remaining planned drop region which is the planned drop region of this time.

14. A liquid crystal dropping method for dropping liquid crystal discharged from discharging ports of a liquid crystal dropping head on a planned drop region, comprising:

discharging the liquid crystal from only one or some of discharging ports among the plurality of discharging ports located in correspondence with the planned drop region of the liquid crystal dropping head at the time of the last scanning, wherein when an entire dropping subject width W of the planned drop region has a relation ($W=n\times L+\alpha$ (n is an integer, $\alpha<L$)) with respect to the entire discharging width L of the liquid crystal dropping head, at the time of a last scanning but one among all scanning carried out by the liquid crystal dropping head for the entire planned drop region, and at the time of the last scanning, a liquid crystal band-like body corresponds to the partial discharging width $\alpha$ is dropped on a remaining planned drop region which is the planned drop region of this time.

* * * * *